United States Patent [19]

Huang

[11] Patent Number: 4,999,861

[45] Date of Patent: Mar. 19, 1991

[54] WAVE MOTION BED

[76] Inventor: Mike H. Huang, 1149 Sackston Ridge, St. Louis, Mo. 63141

[21] Appl. No.: 502,936

[22] Filed: Apr. 2, 1990

[51] Int. Cl.[5] ..... A61G 7/057

[52] U.S. Cl. ..... 5/60; 128/33

[58] Field of Search ..... 5/60, 446, 447, 108, 5/109; 128/33

[56] References Cited

U.S. PATENT DOCUMENTS

| | | | |
|---|---|---|---|
| 2,672,860 | 3/1954 | Badger et al. | 128/33 |
| 3,298,363 | 1/1967 | Parkin | 128/33 |
| 3,656,190 | 4/1972 | Regan et al. | 5/60 |
| 3,999,234 | 12/1976 | Regan | 5/464 |
| 4,267,610 | 5/1981 | Blakeway et al. | 5/60 |
| 4,494,260 | 1/1985 | Olds et al. | 5/60 |
| 4,625,487 | 12/1986 | Blakeway | 5/60 |
| 4,769,864 | 9/1988 | Park | 5/190 |
| 4,799,276 | 1/1989 | Kadish | 5/453 |

OTHER PUBLICATIONS

Joanne M. Sammer, Taking the Pressure Off RX Homecare, 4/89, pp. 28–29.

Kay Nimit, M.D. Guidelines for Home Air-Fluidized Bed Therapy Health Technology Assessment Reports, 1989, #5 (Entire Text).

*Primary Examiner*—Alexander Grosz

*Attorney, Agent, or Firm*—Kalish & Gilster

[57] ABSTRACT

A therapeutic bed includes a body support apparatus having first and second ends and extends longitudinally therebetween. A wave production mechanism causes transverse waves to repetitively form and travel at a predetermined amplitude and a predetermined periodicity along a longitudinal axis of the body support from the second end to the first end thereof. The new bed is intended to decrease the occurrence of pressure sores upon a body supported on the bed by periodically varying the pressure asserted along the length of the body support apparatus against a body supported thereon.

15 Claims, 4 Drawing Sheets

WAVE MOTION BED

BACKGROUND AND SUMMARY OF THE INVENTION

This invention relates, in general, to the field of therapeutic beds, and more particularly, to a bed provided with a mechanism for inducing waves along the length thereof, for treatment and prevention of pressure sores.

The problem of pressure sores, also known as decubitus ulcers or bed sores, has long been of concern for patients who are confined to bed for extended periods of time. The problem has been discussed recently in an article by Joanne M. Sammer, *Taking The Pressure Off*, published in the April, 1989, issue of Rx Home Care, pages 28 and 29, as well as in the more extensive article *Guidelines For Home Air-Fluidized Bed Therapy*, published by the United States Department of Health and Human Services in the Health Technology Assessment Reports, 1989, No. 5, by Kay Nimit M.D.

Ms. Sammer discusses the various stages of ulcers which may form in the skin, stage 1 being the least serious and stage 4 being the deepest ulcer; the damage occurring and worsening if pressure against the skin is greater than 32 mm/Hg for more than two hours. Many factors complicate the problems of pressure sores, including the patient's extreme weight or fragility, which make a patient more difficult to turn at regular intervals, or other health complications such as diabetes. Each patient's conditions are different and thus may require a different sort of care. The Health and Human Services article discusses one method of dealing with pressure sores. Air-fluidized bed therapy (AFBT) involves "flotation" of a body on fine ceramic beads which have been set in motion by a flow of warm pressurized air. Although initially developed for use in hospitals, AFBT is also being used by individuals in the home.

Other methods have been devised also for treating and preventing pressure sores in bed-ridden patients. For example, U.S. Pat. No. 3,656,190 to Regan et al shows a bed having multiple piston-like support elements which conform to the shape of the body and may be moved sequentially so as to provide a wave-like effect along the length of the body. A similar patent, U.S. Pat. No. 3,999,234 also to Regan teaches vertical piston-like elements which adapt to the shape of the body and have a spring element incorporated therein.

By contrast, U.S. Pat. No. 4,267,610 to Blakeway et al illustrates a therapeutic body support having a series of side by side rollers which move in unison back and forth and are covered by a sheet to separate the rollers from the user. U.S. Pat. No. 4,494,260 to Olds et al shows a similar idea where, rather than rollers, horizontal, transverse support blocks of foam or other resilient material are mounted on carriers which oscillate back and forth in unison along the upper surface of the bed to provide varied pressure to a body thereon. Likewise, the U.S. Pat. No. 4,625,487 to Blakeway illustrates tiltable parallel elements such as cushions. However, the support elements of Blakeway '487 are capable of movement in opposed directions, rather than all moving simultaneously, as in Olds et al.

U.S. Pat. No. 4,769,864 to Park illustrates a very simple therapeutic bed consisting of elongated tensile, tubular wires which pass back and forth across the width of the bed and, although strung tightly, allow some "give" for a massaging action to a body thereon.

More recently, U.S. Pat. No. 4,799,276 to Kadish teaches another vertical piston form of a therapeutic bed in which valves are provided associated with and controlling the discharge of air from piston chambers under pressure applied to each of the respective support pistons. After a preset time and level of pressure prevailing, air is discharged from the piston chamber to allow downward displacement of the respective piston.

Among other efforts of the prior art to provide beds which will prevent decubitus ulceration from occuring, there have been proposed various rocking beds, warm air-fluidized beds, and proposals for the use of various types of flotation cushions. Such prior apparatuses typically have been undesirably expensive and complicated. Other difficulties of the prior art may also be noted. For example, the use of air-fluidization technique is likely to cause patient dehydration, and the air-fluidized bed also presents difficulty of the patient tending to "float" upon the surface. This presents further difficulty for care attendants in that the patient is difficult to turn and may tend to sink into the bed. Another difficulty inherent in such prior art constructions which provide patient movement such as by rocking, is that the patient may incur nausea. Further, the rocking type of bed, in its moving of the patient back and forth, is likely to interfere with other patient activities such as work or tasks involving the need for eye fixation on a particular person or thing.

A further limitation of the prior art, particularly the rocking bed, is that the apparatus is visually intimidating and imposing, and thereby is psychologically undesirable. That is, the apparatus does not look like a "regular" bed.

Accordingly, it is among the objects of the present invention to provide a method and apparatus for carrying out the method for prevention and/or treatment of pressure sores in bed-ridden persons. It is intended that the present invention be relatively simple to manufacture and operate as well as being relatively inexpensive, yet capable of providing variable conditions of movement depending on the needs and preferences of the particular patient. Moreover, it is intended that the above objects be achieved without inducing nausea in the patient or creating other risks to the patient, such as from burns or dehydration. Moreover, it is desired to provide such an apparatus which can be easily cleaned and may be quickly disassembled and reassembled for that purpose.

Among still further objects of the present invention may be noted the provision of such apparatus which, in addition to its relative mechanical simplicity, looks like a "regular" bed and so is psychologically advantageous for the patient and others who may have dealings with the patient; which is adjustable in different ways to provide different possible effects, as by adjustment in the amplitude of movement of its members and adjustment of the speed of operation.

Among still further objects of the invention may be noted the provision of such apparatus and method which brings about a natural systolic-diastolic variation in pressure upon the body, and in doing so, provides what is in actuality a traveling wave along the surface of the bed which provides a pumping action with such systolic-diastolic variation, is very much like the normal heart action. Thus, it is among the objects of the invention to provide such a method and apparatus which is highly therapeutic and beneficial to the patient.

Accordingly, in furtherance of the above objects, the present invention is, briefly, a therapeutic bed including a body support means having first and second ends and extending longitudinally therebetween. The new bed includes wave production means for causing transverse waves to repetitively form and travel at a predetermined amplitude and a predetermined periodicity along a longitudinal axis of the body support means from the second end to the first end thereof. Use of the new bed permits a decrease in the occurrence of pressure sores upon a body supported on a bed by periodically varying the pressure asserted along the length of the body support means against the body supported thereon.

The present invention also comprises briefly, a method for decreasing the incidence of pressure sores in a person supported by a bed for an extended time intervals. The method includes supporting the person longitudinally upon a bed having a longitudinal axis, first and second opposing ends, and a support surface extending therebetween. The method further includes repetitively causing transverse waves to be formed and to travel at a predetermined amplitude and a predetermined periodicity along the length of the bed body support surface from the second end to the first end of the bed. The new method permits periodically varying the pressure asserted by the bed against the body supported thereon.

Other objects and features will be in part apparent and in part pointed out hereinbelow.

DESCRIPTION OF THE PREFERRED EMBODIMENT

Figure 1:
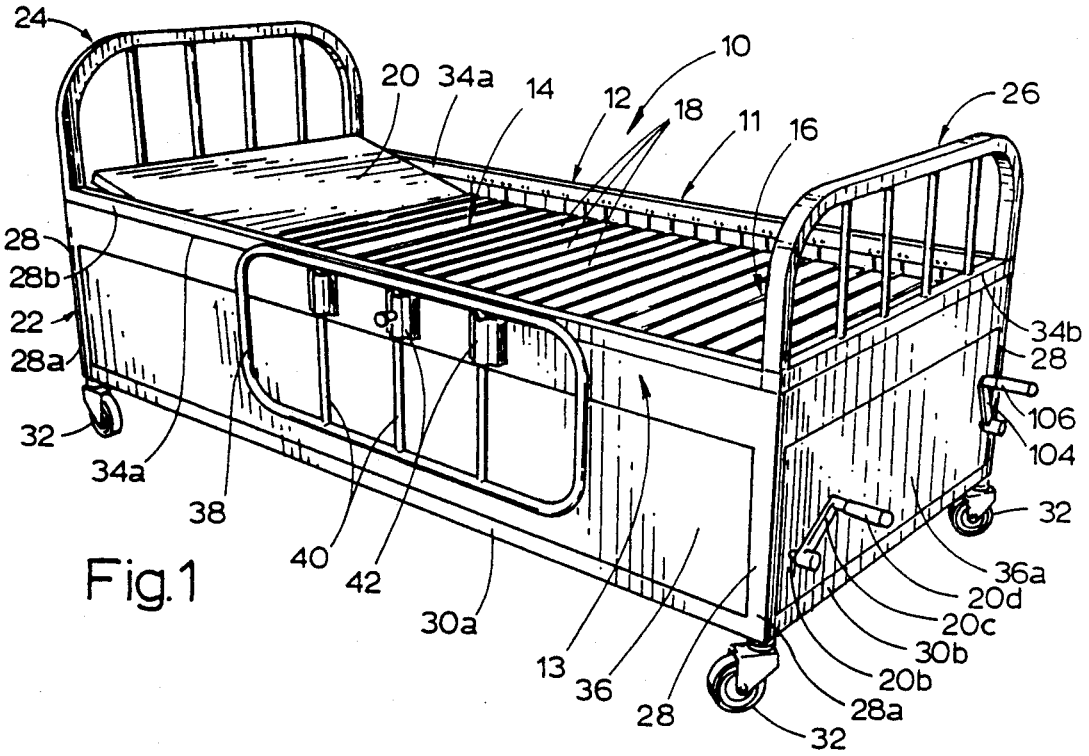
FIG. 1 is a perspective view of a therapeutic bed, constructed in accordance with and embodying the present invention.

Referring to the drawings, illustrated in FIGS. 1–6 and generally designated 10 is a therapeutic wave motion producing bed. A body support surface, generally designated 12, has a first end 14 and a second end 16 and extends longitudinally therebetween, so as to be suitable for supporting a pad or thin mattress thereon. Body support surface 12 is preferably disposed upon a bed frame, generally designated 22, and is provided with multiple transverse rigid slats 18, approximately two inches wide, positioned horizontally, side by side, perpendicular to a longitudinal axis of the bed. For clarity, some such slats are not shown in FIG. 3, but ordinarily are sufficient in number to effectively cover the length of support surface 12.

Figure 2:
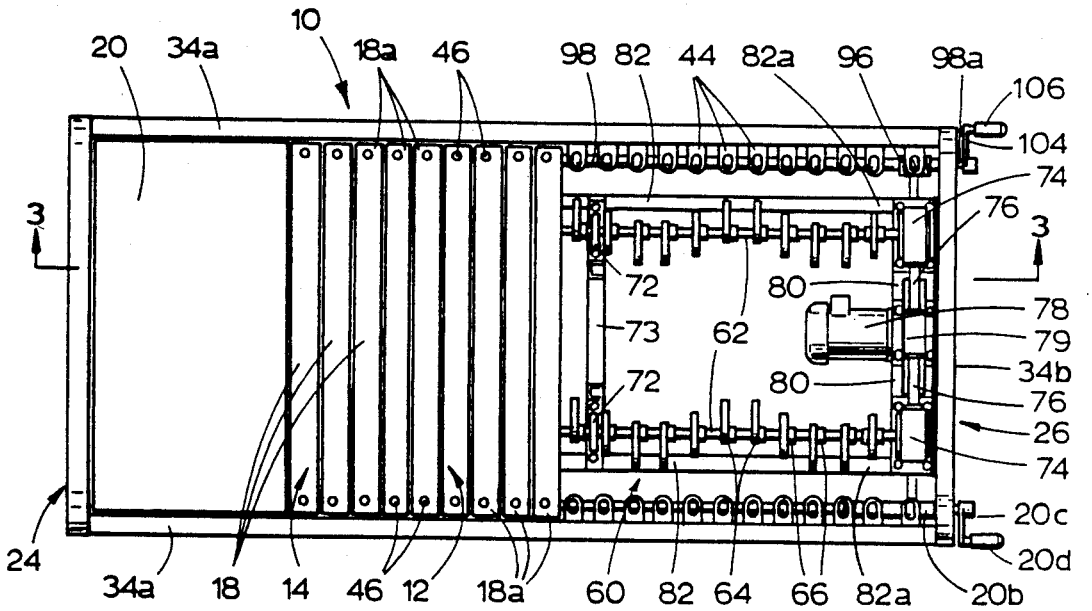
FIG. 2 is a top plan view of the bed of FIG. 1 with some of the transverse slats of the body support surface removed.

A planar head support 20, such as for positioning a pillow thereon, is disposed substantially horizontally and longitudinally between first body support surface end 14 and a first end 24 of bed frame 22. Optionally, planar head support 20 may be adjustable, for example, as by connection to a lever mechanism, generally designated 20*a* (FIG. 3) made operable by attachment to a crankshaft 20*b* (FIG. 2) in turn made rotatable by seating within crank 20*c* having a turnable handle 20*d* (FIGS. 1 and 2).

Figure 3:
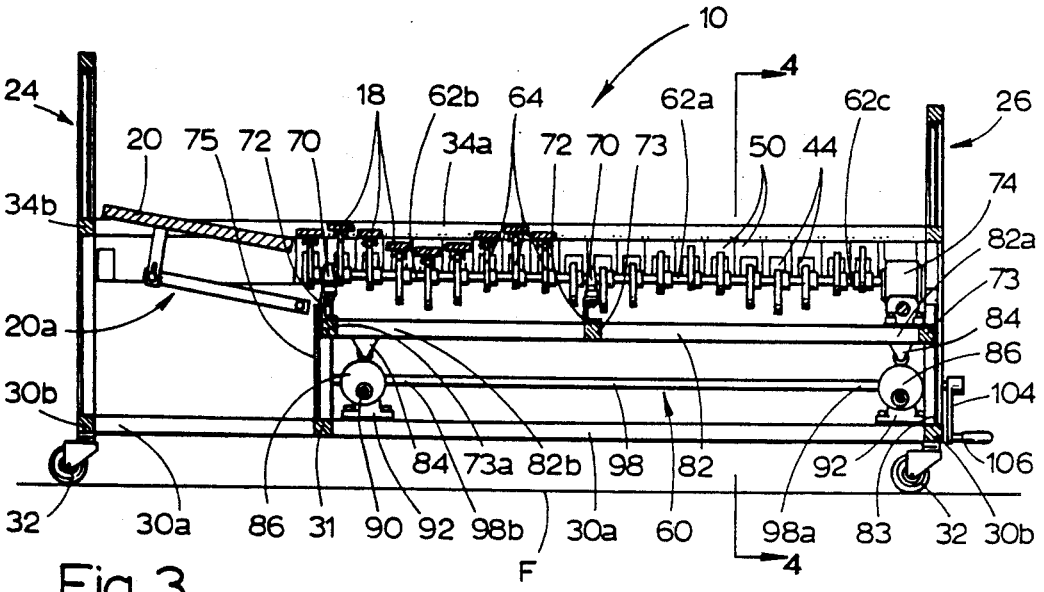
FIG. 3 is a side sectional view of the bed of FIG. 1 taken on line 3—3 of FIG. 2.

A second bed frame end 26 provides a "foot" for bed 10. Bed frame 22 preferably includes four vertical bed legs 28, terminating in lower ends 28*a* rigidly connected by lower horizontal frame bars 30*a*, 30*b*. In the usual configuration, bars 30*a*, 30*b* will form a rectangle, bars 30*b* being the shorter sides and bars 30*a* being the longer sides thereof, corresponding to the general planar shape of bed 10. Preferably, at least one transverse support bar 31 also connects lower horizontal frame bars 30*a* at opposing points thereon (FIG. 3).

Conventional caster mechanisms 32 are swivelly mounted beneath each leg end 28*a* for permitting facile movement of bed 10 upon a floor or other support surface. Upper horizontal frame 34 elements (34*a* indicating longitudinal elements and 34*b* indicating transverse elements) serve to connect upper ends 28*b* of bed frame legs 28. The area bounded by legs 28 and horizontal frame elements 30*a*, 30*b* substantially to 34*a*, 34*b*, respectively, is enclosed by solid vertical panels 36, 36*a* to hinder access to the space beneath bed 10. Preferably, a safety railing 38, is disposed along either one or both bed 10 sides 11, 13 and, for example, includes vertical bars 40 for slidably adjustable attachment via brackets, such as shown at 42, fixed to upper horizontal frame elements 34*a*, as shown in FIG. 1.

A plurality of bushings 44 (FIG. 5) are securely fixed to bed frame 12, for example, as by attachment of integral extensions 50 which are in turn connected by screws 53 to opposing inward turning portions 35 of longitudinal upper horizontal frame elements 34*a*. Bushings 44 (preferably formed of polytetrafluoroethylene, such as sold under the trade designation "TEFLON") are fixed vertically side by side along longitudinal upper housing frame elements 34*a* on the innermost surface thereof for slidable passage therethrough of preferably stainless steel vertical posts 46 (FIGS. 5, 5*a*) depending from each end 18*a* of rigid transverse slats 18 of body support surface 12. Use of such material for bushings 44 provides very low-friction, and nearly noiseless operation.

Positioned inward from ends 18*a* of rigid horizontal slats 18 and depending therefrom are flanges 54 (FIG. 5) for rotatable connection of follower rollers 52 by pins 56. Rollers 52 are positioned such that one roller depends from each opposing end 18*a* of each rigid slat 18, equidistant from such ends, inward of posts 46, and rotating perpendicularly in relation to the longitudinal axis of bed 10.

Figure 4:
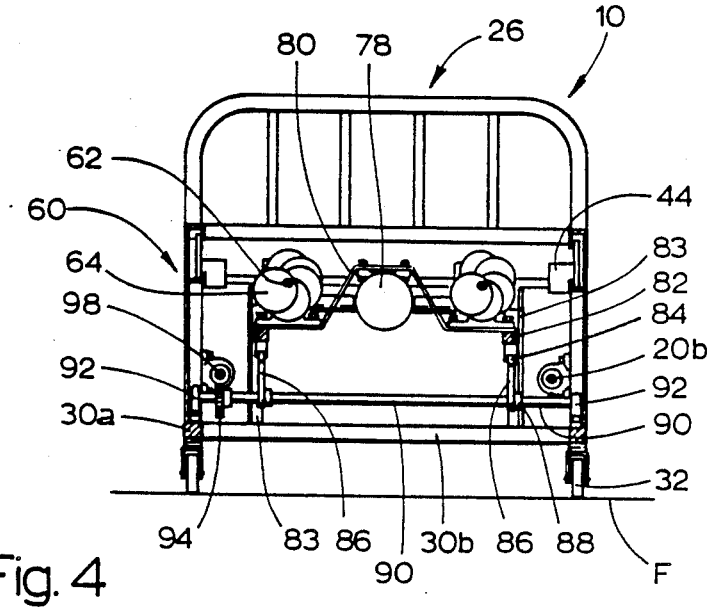
FIG. 4 is a front sectional view of the bed of FIG. 1 taken on line 4—4 of FIG. 3.
Figure 5:
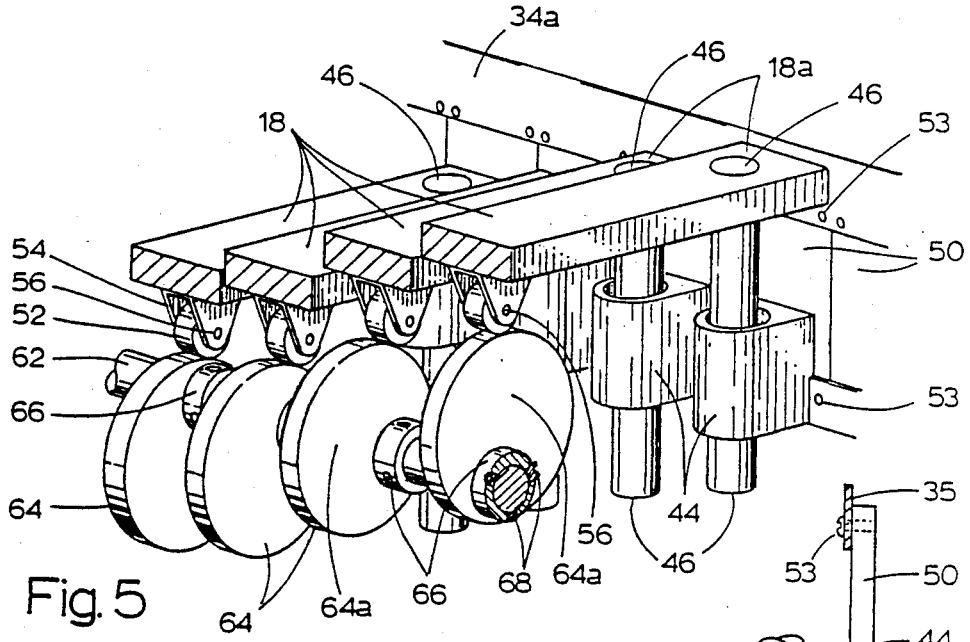
FIG. 5 is a partial elevational view of the cam shaft, cams and followers of the body support means of the bed of FIG. 1.
Figure 5A:
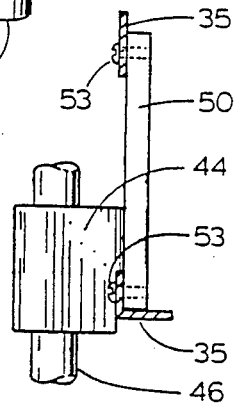
FIG. 5*a* is a breakaway and sectional view of a bushing attached to a side of the bed of FIG. 1 and having a post of a slat/follower positioned therein.
Figure 6:
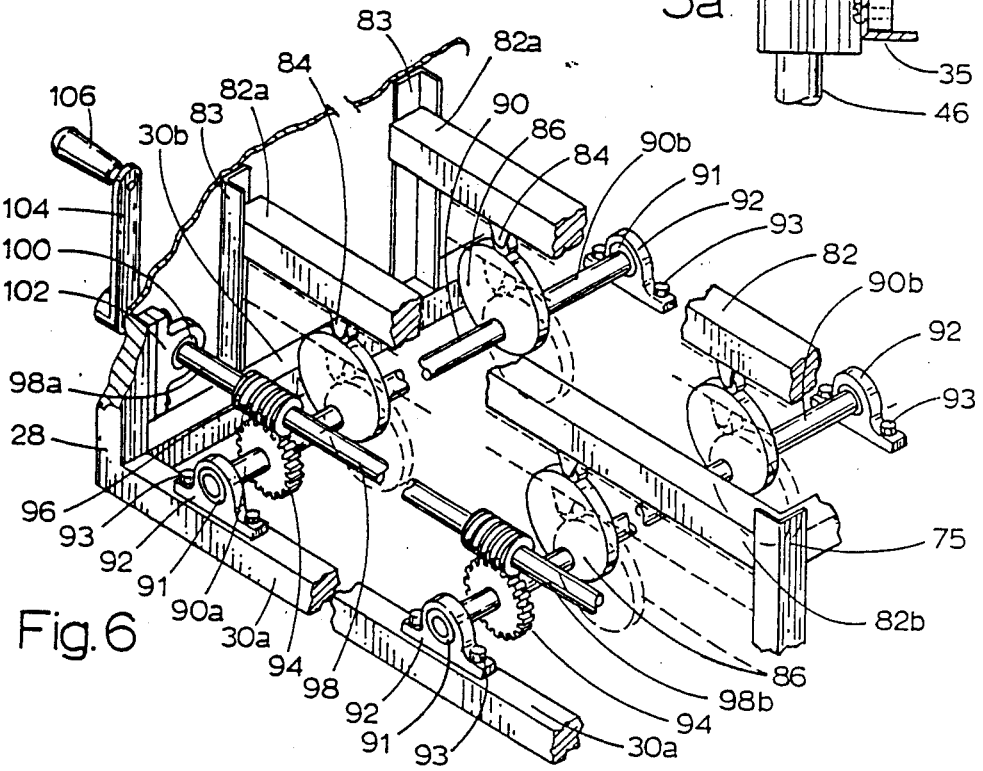
FIG. 6 is a partial breakaway view of the inside of the bed of FIG. 1, illustrating the worm gear mechanism and showing the transverse followers in raised and lowered position.

A wave motion mechanism, generally designated 60, is located beneath body support surface 12 within the area bounded by bed end and side panels 36, 36*a*, respectively, and is illustrated in FIGS. 2—6. Paired cam shafts 62, are positioned parallel to each other and to corresponding adjacent bed side panels 36*a* and extend longitudinally beneath and parallel to body support surface 12. Cams 64 (having lobes 64a) are mounted as by bushings 66 perpendicularly along the length of cam shaft 62 and secured thereto as by inset screws 68 (FIG. 5). The positioning of cam 64 is such that each such cam 64 is in edgewise contact with a roller 52 one of which depends from each rigid horizontal slat end 18a, as previously described, such that rotation of cams 64 causes rotation of corresponding rollers 52 and results in slats 18 acting as followers which move up and down in response to rotation of corresponding cams 64.

Each cam shaft 62 passes rotatably through guides 70 mounted near the center and head directed portions 62a, 62b, respectively, thereof, (FIG. 3) upon brackets 72 fixed upon transverse support bars 73, 73a. End 62c of cam shafts 62 are each journaled within conventional gear boxes, i.e., speed reduction units, 74 disposed near the foot 26 of bed frame 22 (FIGS. 2 and 3). Transverse shafts 76 connect gear boxes 74 to another speed reduction unit 79 coupled to a motor 78 for driving cam shaft 62 (FIG. 2). A rigid transverse structure 80 is disposed substantially horizontally and parallel to bed frame end 26 (FIGS. 2 and 4) and adjacent thereto for providing a mounting surface for gear boxes 74 and motor 78. Rigid transverse structure 80 is connected at opposing ends thereof to ends 82a of longitudinal support bars followers 82 which travel parallel to, inside of and adjacent to the plane of bed side panels 36. The opposing ends 82b of longitudinal support bars 82 are disposed adjacent to but beneath the level of planar head support 20 and are preferably fixed to transverse support bar 73a (FIG. 3).

Depending from each end 82a, 82b of longitudinal support bars 82 are roller mechanisms 84, similar to those previously described at 52, 54, 56. Roller mechanisms 84 make edgewise contact with cams 86 mounted as by bushings 88 on transverse cam shafts 90. Cam shafts 90 terminate rotatably at opposing ends 90a, 90b thereof in bushings 91 mounted in brackets 92 connected as by bolts 93 to lower longitudinal horizontal bed frame bars 30a. Mounted on shafts 90 outwardly of cams 86 are worm wheels 94 (FIGS. 4 and 6) which engage worm gears 96 fixed to a longitudinal worm gear shaft 98 substantially adjacent to opposing ends 98a, 98b thereof. Opposing ends of worm gear shaft 98 are journaled in bushings 100 for rotatably penetrating brackets 102 positioned vertically upon bed frame 22, as at 28 in FIG. 6. One end 98a of worm gear shaft 98 extends through bed end 26 where it terminates in crank 104, made rotatable by manipulation of handle 106.

For stability, transverse support bar 31 (FIG. 3) connects opposing points on lower horizontal bed frame members 30a beneath first end 14 of body support surface 12. Vertical support members 75 connect the intersection of transverse horizontal support member 31 to lower longitudinal horizontal frame members 30a and terminate upwardly in the intersection of longitudinal support bars 82 and transverse support bar 73a (FIG. 3). Vertical support bars 75 are preferably formed of angle iron and serve as guides for ends 82b of longitudinal support bars 82. It is understood that frame 22 of bed 10 may be constructed in a variety of ways that are equally functional. However, the described embodiment is preferred for simplicity and stability.

For use in preventing decubitus sores from forming on bedridden patients, bed 10 is configured and used as hereafter described. A patient (not shown) is placed longitudinally upon and in relation to the longitudinal axis of body support surface 12 with the head of the patient being supported by planar head support 20 and usually cushioned by a pillow, (not shown). Motor 78 is preferably electrically activated and the rotations thereof stepped down as necessary by gears (not shown) housed in reduction units 74, 79 during transfer of motion to cam shafts 62 which rotate in synchrony for corresponding phase-synchronous rotation of the respective cams 64 of shafts 62. Thus, rotation of cams 64 effects vertical movement of cam follower rollers 52 with corresponding upward or downward vertical movement of slats 18. Cams 64 are positioned along cam shaft 62 such that rotation thereof induces a transverse traveling wave to be formed and moved along the length of body support surface 12, preferably from the second end 16 to the first end 14 thereof. This wave motion repeats continuously as long as motor 78 is operating. The length of each individual wave and the frequency thereof is adjustable by presetting the phase differential between adjacent cams and the speed of the motor. It is found that excellent therapeutic conditions result when the phase differential between the cams is 60° and the transverse waves formed by the new invention are formed at a shaft speed of 1-5 rpm corresponding to a wave repetition rate of 1-5 cycles per minute, and more preferably, at 4.2 rpm and with the spacing of cams 64 being such that a plurality of waves, each of wave length λ, will be provided along the body support length of bed 10. With the number of cams 64 illustrated having 60° phase differential between adjacent cams, the number of wave lengths along the body support length is 3.3 λ. If, instead, the cams are phased such that there is an arcuate differential between successive cams of 30°, the number of wave lengths per body support length is 1.65 λ, similarly providing excellent therapeutic conditions.

By necessity, for maintenance of any given slat 18 in its horizontal posture during vertical movement, cams 64 disposed beneath each opposing end 18a thereof must have coordinated positions on their associated cam shafts 62 (FIGS. 2 and 4).

Figure 7:
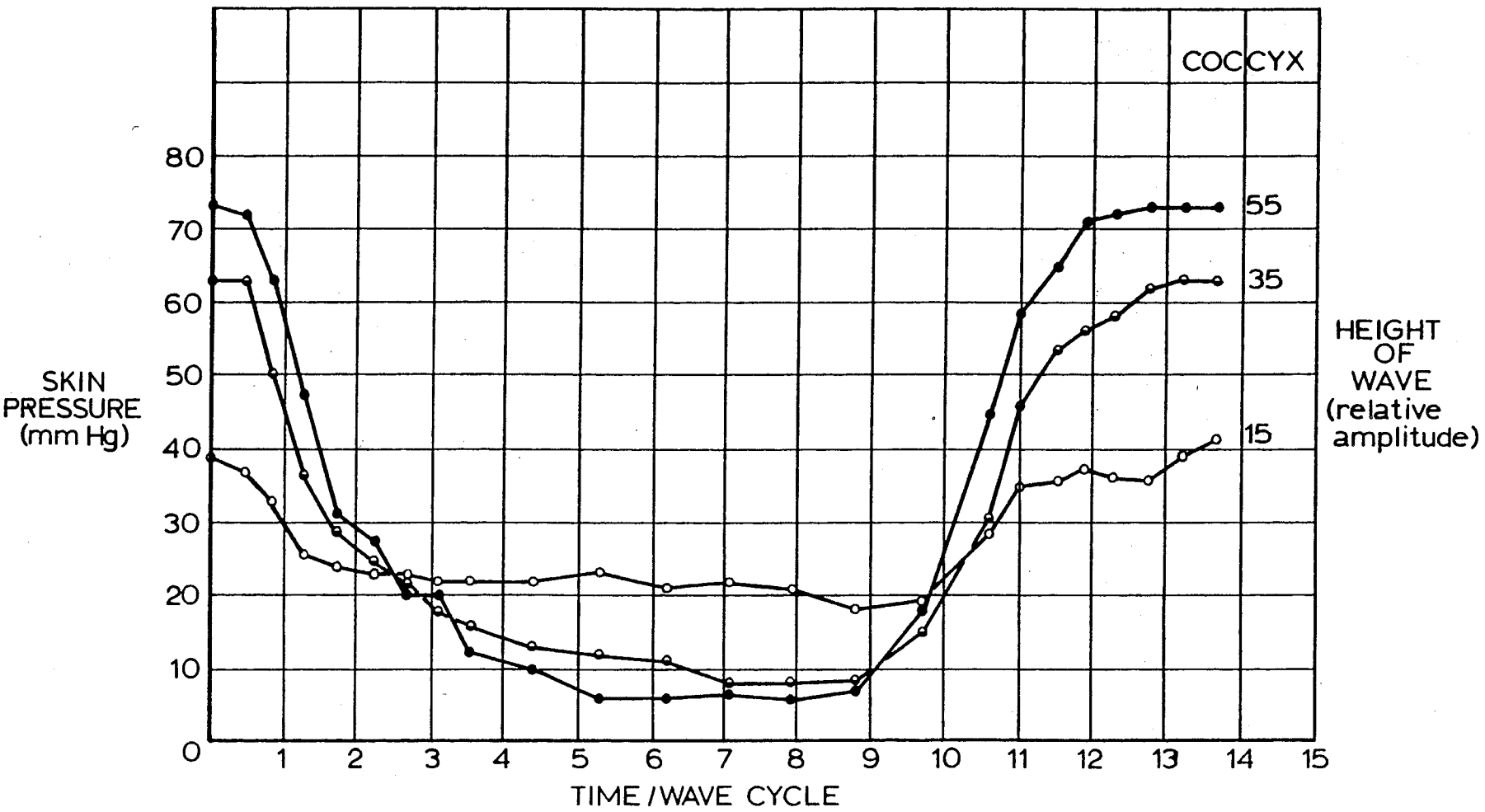
FIG. 7. is a graph showing variations in body pressure and amplitudes of body support members as a function of time, as characteristic of operation of the therapeutic bed of FIG. 1.

The amplitude of moving waves formed by bed 10 is also selectively variable. Manual rotation of worm gear shaft 98 via handle 106 and crank 104 cause rotation of worm gear 94 and thereby worm gear shaft 90 and the associated cams 86. Rotation of cams 86 in turn causes movement of followers 82 via roller mechanisms 84 in contact with cams 86. Thus, ends 82a of rigid longitudinal support bars 82 (having rigid transverse metal structure 80 which supports motor 78 thereon) move up and down within the path formed by vertical supports or guides 83 (illustrated by broken lines in FIG. 6). Opposite ends 82b of longitudinal support bars 82 are cooperatively guided within the "elbow" formed by vertical supports 75. In turn, cam shafts 62 also are raised or lowered along the entire lengths thereof, by virtue of their being attached by brackets 72 and reduction units 74 to longitudinal support bars 82 (FIGS. 2 and 3). FIG. 7 illustrates typical skin pressures measured at the coccyx of a body resting on a bed 10, such pressures varying with the height and periodocity of the wave. The graph shows the left Y axis as skin pressure in millimeters of mercury (mm/Hg), the right Y axis as height of the wave (relative amplitude) and the X axis as time per wave cycle in seconds.

When operated as described herein, bed 10 provides a "pumping action" against the surface of the patient's skin, varying from approximately 6 to 75 mm/Hg, which is much like the pressure of the heart, providing systolic and diastolic variations. The pressure changes are conducive to blood flow in the skin, thus reducing the incidence of pressure sores caused by decreased capillary action in particular skin areas. The maximum variation in body skin pressure is thus selectively variable in accordance with a patient's needs or as prescribed in specific cases.

In view of the foregoing, it will be seen that the several objects of the invention are achieved and other advantages are attained.

Although the foregoing includes a description of the best mode contemplated for carrying out the invention, various modifications are contemplated.

As various modifications could be made in the constructions and methods herein described and illustrated without departing from the scope of the invention, it is intended that all matter contained in the foregoing description or shown in the accompanying drawings shall be interpreted as illustrative rather than limiting.

What is claimed is:

1. A therapeutic bed comprising body support means having first and second ends and extending longitudinally therebetween and wave production means beneath the body support surface for causing transverse waves to repetitively form and travel at a predetermined amplitude and a predetermined periodicity along a longitudinal axis of the body support means from the second end to the first end thereof; the body support means having a plurality of rigid slats positioned horizontally side by side perpendicular to the longitudinal axis of the body support means, and the wave production means including a plurality of longitudinal cam shafts, longitudinal followers beneath and parallel to the longitudinal cam shafts, and a longitudinal follower adjustment assembly in contact with the longitudinal followers for causing vertical motion of the longitudinal followers, for selectively adjusting a vertical position of the longitudinal cam shafts relative to a floor, thus varying the amplitude of waves formed and moved along the length of the body support means, whereby to decrease the occurrence of pressure sores upon a body supported on the bed by periodically varying the pressure asserted along the length of the body support means against a body supported thereon.

2. A therapeutic bed in accordance with claim 1, wherein the bed further comprises a bed frame having first and second ends corresponding to the first and second ends of the body support means, a plurality of legs supporting the bed frame upon a support surface, and first and second parallel bed sides extending between the first and second bed frame ends.

3. A therapeutic bed in accordance with claim 2, wherein the bed frame further comprises panels extending between the legs from each bed frame end and each bed frame side, substantially from the body support means to the support surface, to deter access to an area beneath the bed frame.

4. A therapeutic bed in accordance with claim 1, wherein the rigid slats comprise first and second ends and are provided with rods depending from each first and second end, and the first and second bed sides are provided along the length thereof with vertically mounted bushings for slidably receiving the rods, for permitting slidable vertical movement of the rigid horizontal slats of the body support means.

5. A therapeutic bed in accordance with claim 4, wherein the bushings are comprised of polytertrafluoroethylene.

6. A therapeutic bed in accordance with claim 1, wherein the bed further comprises an adjustable, planar head support disposed longitudinally beyond the first end of the body support means.

7. A therapeutic bed in accordance with claim 1, wherein the bed further comprises an electric motor for powering rotation of the plurality of longitudinal cam shafts.

8. The therapeutic bed of claim 1, wherein the longitudinal followers are positioned parallel to the longitudinal axis of and beneath the body support means and are provided with brackets mounted along the length thereof for rotatably connecting a plurality of longitudinal cam shafts thereto, and the longitudinal follower adjustment assembly comprises a plurality of parallel worm wheel shafts transversely mounted beneath the body support means and having worm wheels fixed thereto, a plurality of worm gear shafts mounted parallel to the longitudinal axis of the body support means, a worm gear disposed near opposing ends of the longitudinally mounted worm gear shafts such that each worm gear interconnects with one of the worm wheels, a plurality of cams mounted along each worm wheel shaft inwardly of the worm wheels, second rollers mounted on the longitudinal followers in edgewise contact with the cams mounted upon the corresponding worm wheel shafts, and a rotatable handle connected to an end of a worm gear shaft, such that rotation of the worm gear shaft by rotation of the handle causes rotation of the worm wheel shaft and its associated cams, subsequently causing rotation of the second rollers and thus vertical motion of the longitudinal followers, so that a vertical position of the longitudinal cam shafts relative to the floor may be selectively adjusted, thus varying the amplitude of waves formed and moved along the length of the body support means.

9. A therapeutic bed comprising body support means having first and second ends and extending longitudinally therebetween and wave production means beneath the body support surface for causing transverse waves to repetitively form and travel at a predetermined amplitude and a predetermined periodicity along a longitudinal axis of the body support means from the second end to the first end thereof; the body support means having a plurality of rigid slats positioned horizontally side by side perpendicular to the longitudinal axis of the body support means; the wave production means including first rollers mounted on each rigid slat, a plurality of parallel cam shafts having first and second ends extending longitudinally therebetween beneath the body support means, and a plurality of cams mounted along the length of each longitudinal cam shaft, the cams contacting the first rollers mounted on each slat, such that the rigid slats vertically follow the motion of the cams when the longitudinal cam shafts are rotated, such that rotation of the longitudinal cam shafts causes waves to be formed and to travel along the length of the body support means, whereby to decrease the occurrence of pressure sores upon a body supported on the bed by periodically varying the pressure asserted along the length of the body support means against a body support thereon.

10. A therapeutic bed in accordance with claim 9, wherein the cams are positioned at intervals from each other along the cam shafts and lobes thereof are arcuately shifted in succession by an arcuate differential between the lobes of adjacent cams of 60°.

11. A therapeutic bed in accordance with claim 10, wherein the cams and associated slats are sufficient in number to form 3.3 λ per body support means length, there being 6 cams per λ.

12. A therapeutic bed in accordance with claim 9, wherein the cams are positioned at intervals from each other along the cam shafts and lobes thereof are arcuately shifted in succession by an arcuate differential between the lobes of adjacent cams of 30°.

13. A therapeutic bed in accordance with claim 12, wherein there are 1.65 λ per body support means length.

14. The therapeutic bed of claim 24, wherein the wave production means is further provided with longitudinal followers beneath and parallel to the longitudinal cam shafts, and a longitudinal follower adjustment assembly in contact with the longitudinal followers for causing vertical motion of the longitudinal followers, for selectively adjusting a vertical position of the longitudinal cam shafts relative to a floor, thus varying the amplitude of waves formed and moved along the length of the body support means.

15. The therapeutic bed of claim 14, wherein the longitudinal followers are positioned parallel to the longitudinal axis of and beneath the body support means and are provided with brackets mounted along the length thereof for rotatably connecting a plurality of longitudinal cam shafts thereto, and the longitudinal follower adjustment assembly comprises a plurality of parallel worm wheel shafts transversely mounted beneath the body support means and having worm wheels fixed thereto, a plurality of worm gear shafts mounted parallel to the longitudinal axis of the body support means, a worm gear disposed near opposing ends of the longitudinally mounted worm gear shafts such that each worm gear interconnects with one of the worm wheels, a plurality of cams mounted along each worm wheel shaft inwardly of the worm wheels, second rollers mounted on the longitudinal followers in edgewise contact with the cams mounted upon the corresponding worm wheel shafts, and a rotatable handle connected to an end of a worm gear shaft, such that rotation of the worm gear shaft by rotation of the handle causes rotation of the worm wheel shaft and its associated cams, subsequently causing rotation of the second rollers and thus vertical motion of the longitudinal followers, so that a vertical position of the longitudinal cam shafts relative to the floor may be selectively adjusted, thus varying the amplitude of waves formed and moved along the length of the body support means.

* * * * *

UNITED STATES PATENT AND TRADEMARK OFFICE

CERTIFICATE OF CORRECTION

PATENT NO. : 4,999,861

DATED : March 19, 1991

INVENTOR(S) : Mike H. Huang

It is certified that error appears in the above-identified patent and that said Letters Patent is hereby corrected as shown below:

Col. 7, li. 67, "polytertra-" should be --polytetra--; and

Col. 9, li. 13, "24" should be --9--.

Signed and Sealed this

Seventeenth Day of November, 1992

*Attest:*

DOUGLAS B. COMER

*Attesting Officer*

*Acting Commissioner of Patents and Trademarks*